US006979234B2

(12) United States Patent
Bleicher

(10) Patent No.: US 6,979,234 B2
(45) Date of Patent: Dec. 27, 2005

(54) PLUG CONNECTION DEVICE

(75) Inventor: Martin Bleicher, Fichtenau (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/700,926

(22) Filed: Nov. 4, 2003

(65) Prior Publication Data

US 2004/0259428 A1 Dec. 23, 2004

(30) Foreign Application Priority Data

Nov. 13, 2002 (EP) ..... 02025528

(51) Int. Cl.[7] ..... H01R 13/40
(52) U.S. Cl. ..... 439/733.1; 439/943; 439/82
(58) Field of Search ..... 439/733.1, 943, 439/82, 567, 97, 737, 738, 564, 573

(56) References Cited

U.S. PATENT DOCUMENTS 3,897,131 A * 7/1975 Stauffer ..... 439/733.1
4,021,094 A * 5/1977 Hild et al. ..... 439/733.1
4,097,101 A * 6/1978 Holt et al. ..... 439/82
4,274,700 A * 6/1981 Keglewitsch et al. .... 439/733.1
4,381,134 A * 4/1983 Anselmo et al. ..... 439/82
4,473,267 A * 9/1984 Sadigh-Behzadi ..... 439/271
4,526,429 A * 7/1985 Kirkman ..... 439/82
5,185,479 A * 2/1993 Stauffer ..... 568/893
5,616,052 A * 4/1997 Pan et al. ..... 439/573
5,885,113 A * 3/1999 Bricaud ..... 439/733.1
6,042,429 A 3/2000 Bianca et al. ..... 439/733.1
6,149,471 A * 11/2000 Kemp et al. ..... 439/733.1
6,371,804 B1 * 4/2002 Kuo et al. ..... 439/573

FOREIGN PATENT DOCUMENTS

EP 0 488 487 A1 6/1992
GB 1060271 3/1967

OTHER PUBLICATIONS

European Search Report, Application No. EP 03 02 4879, dated Feb. 20, 2004.

* cited by examiner

*Primary Examiner*—Tho D. Ta
(74) *Attorney, Agent, or Firm*—Barley Snyder LLC

(57) ABSTRACT

A plug connection device comprises a contact pin and a receiving element. The contact pin has an outer surface. The receiving element has openings. Each of the openings has an inner surface that contacts the outer surface of the contact pin when the contact pin is received therein. The plug connection device has grooves extending in a radial direction. A distance between adjacent grooves is smaller than a distance between adjacent openings.

18 Claims, 2 Drawing Sheets

PLUG CONNECTION DEVICE

FIELD OF THE INVENTION

The invention relates to a plug connection device and, more particularly, to a plug connection device that includes a receiving element with at least one opening for receiving a contact pin wherein a surface of the contact pin is connected to an inner surface of the receiving element.

BACKGROUND OF THE INVENTION

Conventional plug connection devices are used in the production of electronic components and comprise a receiving element having a housing with at least one opening for receiving a contact pin. When mated, a surface of the contact pin is connected, at least in certain sections, to an inner surface of the receiving element. The housing is typically an insulative plastic housing, such as, a header, and the contact pin is conductive and typically made from, for example, a drawn wire. The housing and/or the contact pin have machining marks that extend substantially in a longitudinal direction, i.e., parallel to a mating direction, that are formed during production. Because of the method of production of the contact pin and the housing, when the drawn wire is mated with the plastic housing, shavings are formed. The shavings are only a few hundredths of a millimeter thick, however, the shavings can attain a length that is sufficient to bridge adjacent contact pins positioned in the housing, which may result in a short circuit.

SUMMARY OF THE INVENTION

It is, therefore, an object of the invention to provide a plug connection device that prevents the occurrence of short circuits between adjacent contact pins.

This and other objects are achieved by a plug connection device comprising a contact pin and a receiving element. The contact pin has an outer surface. The receiving element has openings. Each of the openings has an inner surface that contacts the outer surface of the contact pin when the contact pin is received therein. The plug connection device has grooves extending in a radial direction. A distance between adjacent grooves is smaller than a distance between adjacent openings.

This and other objects are further achieved by contact pins for a plug connection device wherein each of the contact pins has an outer surface with contact pin grooves extending in a radial direction. A distance between adjacent contact pin grooves is smaller than a distance between adjacent contact pins.

This and other objects are still further achieved by a receiving element for a plug connection device comprising openings with an inner surface. The inner surface has receiving element grooves extending in a radial direction. A distance between adjacent grooves is smaller than a distance between adjacent openings.

DETAILED DESCRIPTION OF THE INVENTION

Figure 1:
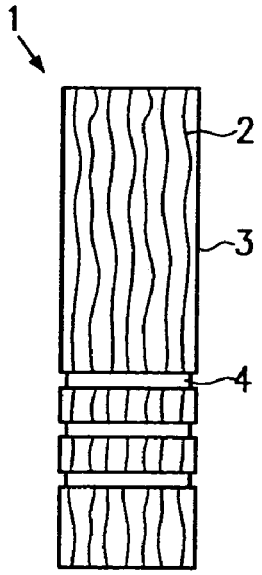
FIG. 1 is a plan view of a first embodiment of a contact pin.

FIG. 1 shows a first embodiment of a contact pin 1 of a plug connection device according to the invention. The contact pin 1 may be, for example, a terminal of an electrical component. The contact pin 1 is made from an electrically conductive material, such as, for example, tin, and has machining marks 2 and contact pin grooves 4 formed on an outer surface 3 thereof. For sake of clarity, the contact pin grooves 4 and the machining marks 2 shown in the figures have been exaggerated. The machining marks 2 are formed in a longitudinal direction, which corresponds to a mating direction. The machining marks 2 are formed during production of the contact pin 1. The contact pin 1 may be formed, for example, from drawn metal wire that may be cut to length for cost efficiency. In the illustrated embodiment, the contact pin 1 is elongated in shape and circular in cross-section for ease of mating with a receiving element 5, shown in FIG. 4. Other embodiments of the contact pin 1, however, are possible. For example, the contact pin 1 may be square or oval-shaped. The machining marks 2 are removed in a region of the contact pin grooves 4, in order to reduce shaving formation. Because the contact pin 1 is formed from a metal, such as, tin, etc., production of the contact pin 1 is cost-efficient and good electrical conductivity is ensured.

The contact pin grooves 4 are formed after cutting the pin contact 1 to length, for example, by engraving or rolling, and are formed to extend transversely to the mating direction. The contact pin grooves 4 extend further in a radial direction than in the longitudinal direction. The contact pin grooves 4 are formed to be larger than any surface unevenness (not shown) of the contact pin 1 to reduce shaving formation. The contact pin grooves 4 are set apart from one another and extend parallel to one another and encircle the contact pin 1 to further reduce shaving formation. The distance of the contact pin groove 4 from the end sections of the contact pin 1, and the distance between adjacent contact pin grooves 4, should be shorter than the distance between adjacent openings 6 of the receiving element 5, to be discussed later.

Figure 2:
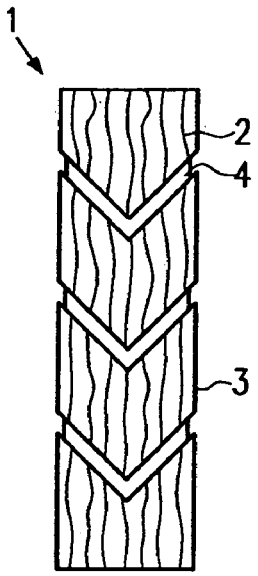
FIG. 2 is a plan view of a second embodiment of the contact pin.

FIG. 2 shows a second embodiment of the contact pin 1 according to the invention. For ease of description, components identical to the first embodiment will not be further described herein, and identical components are designated with identical reference numerals. As shown in FIG. 2, the second embodiment differs from the first embodiment in that the contact pin grooves 4 of the second embodiment have an angular form and are inclined with respect to the longitudinal direction of the contact pin 1 to reduce shaving formation. The contact pin grooves 4 may be inclined by, for example, 45 degrees to further reduce shaving formation.

Figure 3:
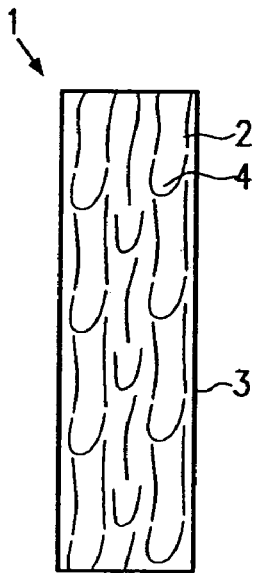
FIG. 3 is a plan view of a third embodiment of the contact pin.

FIG. 3 shows a third embodiment of the contact pin 1 according to the invention. For ease of description, components identical to the first and second embodiments will not be further described herein, and identical components are designated with identical reference numerals. As shown in FIG. 3, the third embodiment differs from the first and second embodiments in that the contact pin grooves 4 of the third embodiment have a teardrop shape and are mutually offset relative to each other. This configuration reduces shaving formation.

Figure 4:
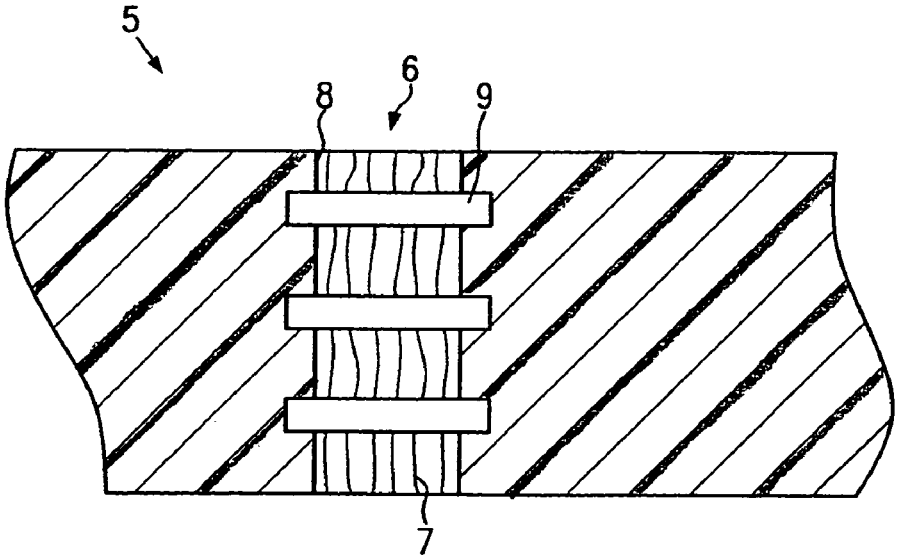
FIG. 4 is a sectional view of a first embodiment of a receiving element.
Figure 5:
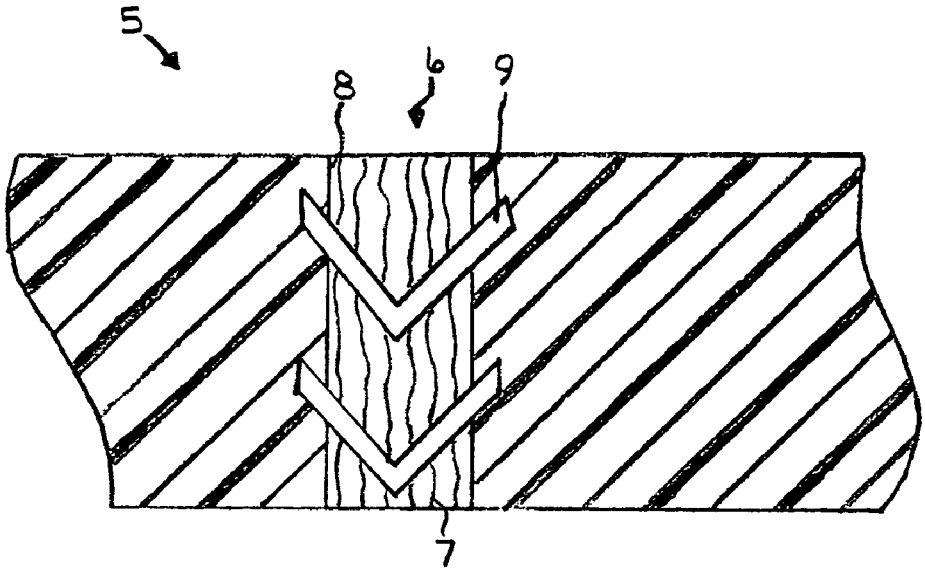
FIG. 5 is a sectional view of a second embodiment of a element.

FIG. 4 shows a first embodiment of the receiving element 5 of a plug connection device according to the invention. The receiving element 5 may be, for example, a circuit board. The receiving element 5 is made from a non-conductive material, such as, plastic or other polymer, to protect against short circuits and to ensure that production is cost-efficient. The receiving element 5 has an opening 6 corresponding to a shape of the contact pin 1 to facilitate insertion therein. The opening 6 may be, for example, a conventional circular opening or an oval or polygonal opening. The opening 6 has a diameter slightly larger than a diameter of the contact pin 1. On an inner surface 8 of the receiving element 5 and extending in a longitudinal direction are machining marks 7. The machining marks 7 correspond to a mating direction and are produced when the opening 6 is formed in the receiving element 5. The opening 6 may be produced, for example, by punching. Although only one of the openings 6 is shown in FIG. 4, the receiving element 5 may have a plurality of openings 6, set apart from one another. One of the contact pins 1 is associated with each of the openings 6.

Figure 6:
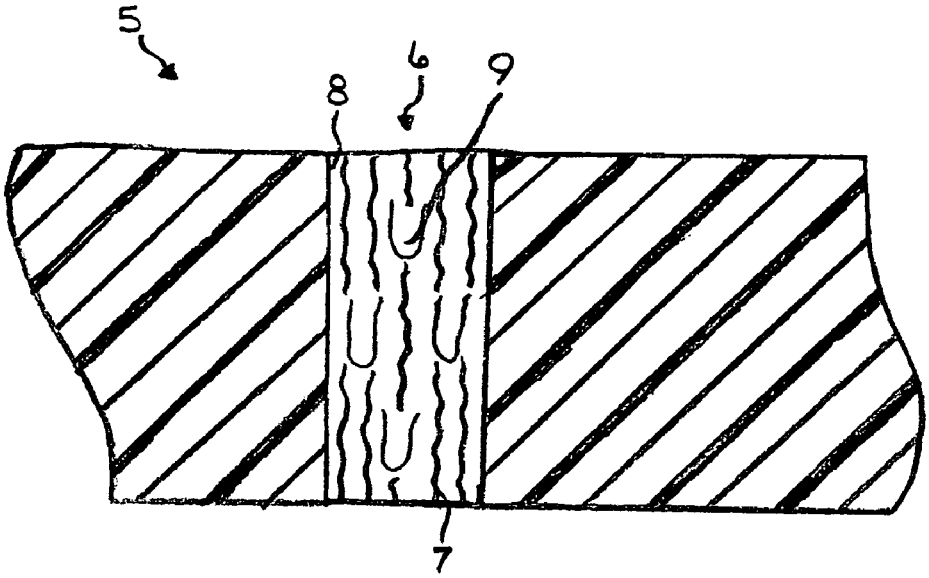
FIG. 6 is a sectional view of a third embodiment of a receiving element.

As shown in FIG. 4, the receiving element 5 has receiving element grooves 9 extending in a radial direction. For sake of clarity, the receiving element grooves 9 and the machining marks 7 have been exaggerated. The receiving element grooves 9 extend transversely to the mating direction. Similar to the contact pin 1, the machining marks 7 on the receiving element 5 are removed in a region of the receiving element grooves 9. Each of the receiving element grooves 9 is larger than any surface unevenness (not shown) of the receiving element 5 to reduce shaving formation, and the receiving element grooves 9 extend further in the radial direction than in the longitudinal direction to further reduce shaving formation. The receiving element grooves 9 encircle the receiving element 5, and a plurality of the receiving element grooves 9 are set apart from one another and extend parallel to one another. The distance of the receiving element groove 9 from an end section of the receiving element 5, and the distance between adjacent receiving element grooves 9, should be shorter than the distance between adjacent openings 6 of the receiving element 5, in order to effectively prevent short circuits. Similar to the contact pin 1, the grooves may be inclined, in certain sections, by, for example, 45 degrees with respect to the longitudinal direction of the receiving element 5, as shown in a second embodiment in FIG. 4. The receiving element grooves 9 may also have an angular form or a teardrop shape, as shown in a third embodiment in FIG. 6. Each of the receiving element grooves 9 is larger than any surface unevenness (not shown) of the receiving element 5 to reduce shaving formation, and the receiving element grooves 9 extend further in the radial direction than in the longitudinal direction to further reduce shaving formation. The receiving element grooves 9 encircle the receiving element 5, and a plurality of the receiving element grooves 9 are set apart from one another and extend parallel to one another. The distance of the receiving element groove 9 from an end section of the receiving element 5, and the distance between adjacent receiving element grooves 9, should be shorter than the distance between adjacent openings 6 of the receiving element 5, in order to effectively prevent short circuits. Similar to the contact pin 1, the grooves may be inclined, in certain sections, by, for example, 45 degrees with respect to the longitudinal direction of the receiving element 5. The receiving element grooves 9 may also have an angular form or a tear-dropped shape.

Assembly and operation of the plug connection device will now be described in greater detail. The contact pin 1 is plugged into the opening 6 of the receiving element 5. In the plugged-in state, the outer surface 3 of the contact pin 1 is connected, at least in certain sections, to the inner surface 8 of the receiving element 5. The contact pin 1 protrudes partially beyond the receiving element 5. Because the surface of the contact pin 1 and/or the inner surface 8 of the receiving element 5 comprises at least one of the contact pin grooves 4 or the receiving element grooves 9 that extends in a radial direction, shaving formation is effectively reduced. If a shaving is produced, the shaving will break in a region of one of the contact pin grooves 4, 9. Because the length of the shaving is controlled, the shaving will remain shorter than the distance between adjacent openings 6. Bridging of neighboring contact pins 1 by the shavings is thereby avoided, reducing the occurrence of short circuits.

I claim:

1. A plug connection device, comprising:

a contact pin formed from a drawn metal wire, the contact pin having an outer surface with machining marks formed in a longitudinal direction;

a receiving element having openings, each of the openings having an inner surface that contacts the outer surface of the contact pin when the contact pin is received therein; and the plug connection device having grooves extending in a radial direction wherein a distance between adjacent grooves is smaller than a distance between adjacent openings.

2. The plug connection device according to claim 1, wherein the receiving element is made from a non-conductive material and the contact pin is made from a conductive material.

3. The plug connection device according to claim 1, wherein the grooves extend transversely to a mating direction of the contact pin.

4. The plug connection device according to claim 1, wherein the machining marks are removed in an area of the grooves.

5. The plug connection device according to claim 1, wherein the grooves extend further in a radial direction than in the longitudinal direction.

6. The plug connection device according to claim 1, wherein the grooves are inclined with respect to the longitudinal direction.

7. The plug connection device according to claim 1, wherein the grooves are formed on the inner surface of the openings of the receiving element and the outer surface of the contact pins.

8. Contact pins for a plug connection device, each of the contact pins comprising:

an outer surface with machining marks formed in a longitudinal direction and contact pin grooves extending in a radial direction, wherein a distance between adjacent contact pin grooves is smaller than a distance between adjacent contact pins, and each of the contact pins is formed from a drawn metal wire.

9. The contact pins according to claim 8, wherein the contact pin grooves extend transversely to a mating direction of a receiving element.

10. The contact pins according to claim 8, wherein the machining marks are removed in an area of the contact pin grooves.

11. The contact pins according to claim 8, wherein the contact pin grooves extend further in a radial direction than in the longitudinal direction.

12. The contact pins according to claim 8, wherein the contact pin grooves are inclined with respect to the longitudinal direction of the contact pin.

13. The contact pins according to claim 12, wherein the contact pin grooves are inclined by about 45 degrees.

14. A receiving element for a plug connection device, comprising:

openings with a substantially uniform inner surface formed for contacting a contact pin, the inner surface having receiving element grooves extending in a radial direction, wherein a distance between adjacent receiving element grooves is smaller than a distance between adjacent openings, each of the receiving element grooves is larger than any surface unevenness of the receiving element, the receiving element grooves extend further in a radial direction than in a longitudinal direction, and the receiving element is made from a non-conductive material.

15. The receiving element according to claim 14, wherein the receiving element grooves extend transversely to a mating direction of a contact pin.

16. The receiving element according to claim 14, wherein machining marks are removed in an area of the receiving element grooves.

17. The receiving element according to claim 14, wherein the receiving element grooves are inclined with respect to a longitudinal direction of the opening.

18. The receiving element according to claim 17, wherein the receiving element grooves are inclined by about 45 degrees.

* * * * *

UNITED STATES PATENT AND TRADEMARK OFFICE

CERTIFICATE OF CORRECTION

PATENT NO. : 6,979,234 B2
DATED : December 27, 2005
INVENTOR(S) : Martin Bleicher It is certified that error appears in the above-identified patent and that said Letters Patent is hereby corrected as shown below:

Column 4,
Line 50, add the following claim:
7. The plug connection device according to claim 6, wherein the grooves are inclined by about 45 degrees.

Signed and Sealed this

Eleventh Day of April, 2006

JON W. DUDAS
*Director of the United States Patent and Trademark Office*